US005431312A

United States Patent [19]

Schumacher

[11] Patent Number: 5,431,312

[45] Date of Patent: Jul. 11, 1995

[54] CONTAINER FOR THE DISPENSING OF LIQUID

[75] Inventor: Clemens Schumacher, Sundern, Germany

[73] Assignee: Robert Finke GmbH & Co. KG, Finnentrop, Germany

[21] Appl. No.: 266,065

[22] Filed: Jun. 27, 1994

[30] Foreign Application Priority Data

Jun. 25, 1993 [DE] Germany ..... 9309443 U

[51] Int. Cl.[6] ..... B65D 83/00

[52] U.S. Cl. ..... 222/398; 222/401; 222/402; 239/359; 239/360

[58] Field of Search ..... 222/394, 398, 401, 402; 239/355, 357, 359, 360, 343; 417/540, 542; 137/512.3

[56] References Cited

U.S. PATENT DOCUMENTS 4,492,320 1/1985 Tada ..... 222/398
5,267,674 12/1993 von Schuckmann ..... 222/401 X

FOREIGN PATENT DOCUMENTS 9208050 1/1993 Germany .
4201094 7/1993 Germany ..... 239/343
4217865 12/1993 Germany .

*Primary Examiner*—Gregory L. Huson
*Attorney, Agent, or Firm*—Martin A. Farber

[57] ABSTRACT

A container (1) for the dispensing of liquid (2), in particular for dispensing in spray or foam form, with dispensing nozzle (D) arranged on the top side of the container (1) and a pump handle (15) for a pump (P) which is associated with the container and has a pump cylinder (11), a piston rod (16) and a pump piston (22) for producing a pressure cushion above the surface (14) of the liquid. The pump chamber (21) has an air inlet valve (V1) and an air outlet valve (V2), and, in order to obtain a structural form which is dependable in function and favorable in use, the air outlet valve (V2) comprises two valves (34, 35) which are connected one behind the other and between which an air volume can be enclosed.

17 Claims, 8 Drawing Sheets

CONTAINER FOR THE DISPENSING OF LIQUID

FIELD AND BACKGROUND OF THE INVENTION

The present invention refers to containers for the dispensing of liquid, in particular for the spray or foam dispensing thereof, with a dispensing nozzle arranged on the top of the container and a handle for a pump which is associated with the container, and has a pump cylinder, piston rod and pump piston for producing a compressed-air cushion above the surface of the liquid, the pump chamber have an air inlet valve and an air outlet valve.

Dispensers of this type are substantially taking the place of devices which operate with environmentally objectionable propellants. One embodiment of this type is known from German OS 42 17 865. One fundamental problem of such devices is that liquid can emerge from the pump which builds up the compressed air above the surface of the liquid. Such leakage losses, even though only slight, are undesired or even unacceptable due to the different properties of the liquids. One reason may be the swelling of the continuously wetted valve bodies which no longer close tightly. Unfavorable tolerances are also frequently the reason for the defect described.

SUMMARY OF THE INVENTION

The object of the present invention, therefore, is to develop a dispenser of this type which is more favorable in use and avoids the disadvantages indicated.

As a result of the invention, a container of the introductorily-mentioned type for the dispensing of liquid which is of increased value in use is obtained. This is achieved in the manner that the air outlet valve consists of two valves arranged one behind the other and between which a volume of air can be enclosed. This results in a sort of lock-gate function. Should liquid be able to pass possibly through the first valve, it is definitely held back against emergence on the next barrier, namely the second valve. Furthermore, during the course of the actuation of the pump, there is always the tendency to discharge any portions of the liquid which have entered in between. Upon the pumping, a pressure corresponding to the operating pressure is produced in the said lock-gate region. In the position of rest, a slight difference between the pressure in the enclosed volume of air and the pressure above the surface of the liquid in the container can thus be advantageously used for a function which assures the closing of the first valve. In addition to this, the entire pump head as well as the valves there are out of the liquid. In a development of this type, in which, furthermore, the first valve is a tube valve, one measure which optimizes the reliability in use is for the second valve to be a disk valve. The stored pressure acts very strongly in valve closing direction on the region of the disk which as, as a rule, is of rather large surface. It is advantageous from a structural standpoint with respect to the arrangement of the valve that an annular chamber with respect to a pin which is arranged coaxially to the axis of the pump piston be formed for the enclosed volume of air. This means, which forms practically the heart of the valve attachment and is furthermore oriented centrally, results in favorable manner in a balanced manner of operation of the pump. It is advantageous in this connection for the pin to cooperate with a valve cuff in order to form the tube valve. The central pin leaves the desired annular chamber present peripherally, and it furthermore performs another function in the manner that, at the same time, the pin serves for the attachment of the disk valve. In order to form an attachment section and a function section of optimal development, it is furthermore proposed that the disk valve be developed with a bell-shaped cross section, gripping over an end of the pin facing away from the pump piston. A structurally simple type of association consists in the disk valve being held by clip engagement on the pin. The desired high sealing action is furthermore also favored by the fact that a groove is developed in a resting-sealing surface for the disk valve, a sealing bead on the disk valve being contained at least partially in sealing condition in said groove. This brings about two spaced sealing zones or planes, with the production of a small-scale lock-gate function, if, furthermore, the sealing bead rests on upper edges of the groove, leaving a free space within the groove. Even a third sealing plane is furthermore obtained in the manner that an outer lipping which lies behind the sealing bead as seen in the direction of flow is provided on the disk valve, it resting in sealing fashion against the resting-sealing surface. The lipping makes the edge of the disk extremely sensitive for the desired third sealing plane. The pressure prevailing above the surface of the liquid holds the lips against their corresponding sealing surface. It is also advantageous for a friction-lock protrusion to be formed on an outer surface of the piston rod, said protrusion entering into action upon the conclusion of a pumping process. In this way, the piston rod cannot slip out of its basic position due for instance to its own weight, or out of the pump cylinder. This would otherwise be possible due to a certain free passage between the inlet valve and the piston rod, particularly as, furthermore, measures are provided which result in a reduction of pressure in the pump chamber so that residual pressures cannot push the piston rod out. Such an arrangement is described in detail in German OS 42 17 865 which forms the prior art for the present invention. Furthermore, in order to obtain a favorable attachment of the valve disk, it is proposed that a clip bead in the form of individual clip noses be formed. This requires a smaller widening, since parts of the attachment section can bridge in chord-like manner over the spaces between the clip noses. The development of the clip noses by molding is favored if the clip noses are arranged in the region of air outlet openings. The latter are thereby imparted a twofold function, namely to permit the emergence of air and then to form an access path for the optimal removal of the clip noses from the mold. Furthermore, it is advantageous for the disk valve to form a detent flank to engage below the clip nose. In order to obtain an attachment of the disk valve which is as free of play as possible but, on the other hand, takes the molding requirements sufficiently into account, it is furthermore proposed that a lower flank of the clip noses form an angle of less than 20° with the detent flank of the valve disk. An angle of about 10° is preferred. Finally, it is also favorable for the lower flank of the clip noses to extend in a horizontal plane and perpendicular to a longitudinal center axis of the piston rod. The lower flank is accordingly developed with a sharp edge.

THE DRAWINGS

With the above and other and other advantages in view, the present invention will become more clearly understood in connection with the detailed description of a preferred embodiment, when considered with the accompanying drawings of which:

FIG. 6 is a vertical section through the upper end of the piston rod, but with the pump piston not yet placed on;

DETAILED DESCRIPTION OF THE PREFERRED EMBODIMENT

Figure 1:
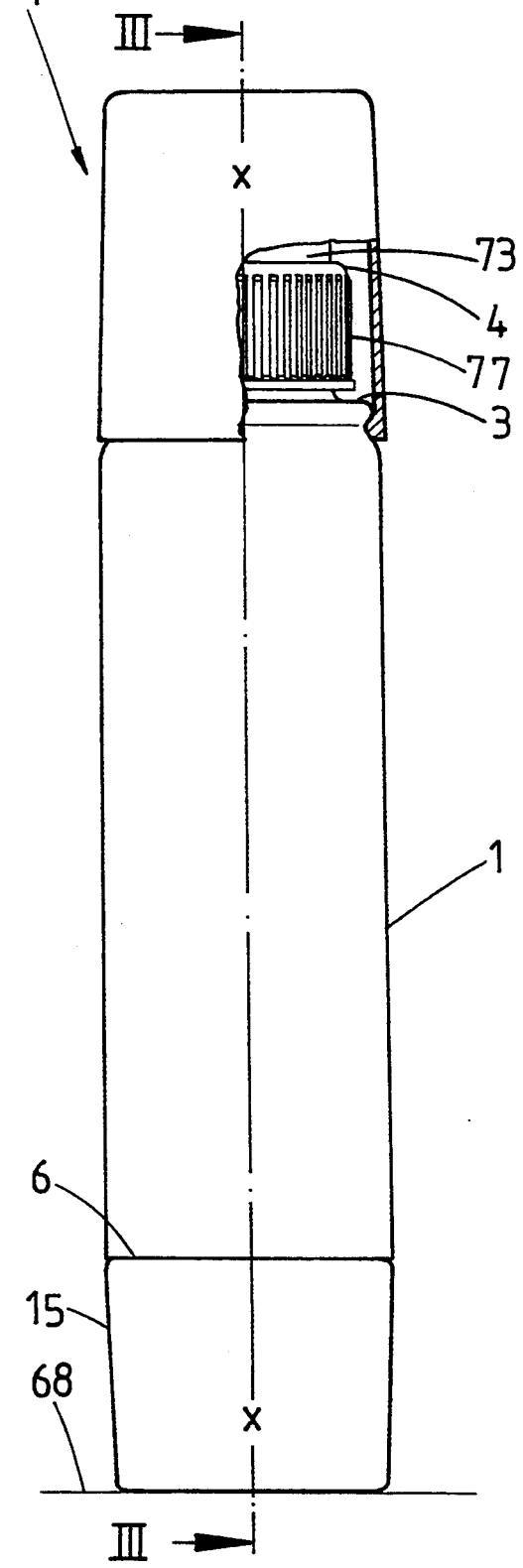
FIG. 1 is a side view of the container, developed as dispenser, with the protective cap partially broken away, shown in the basic position of the pump mechanism.
Figure 2:
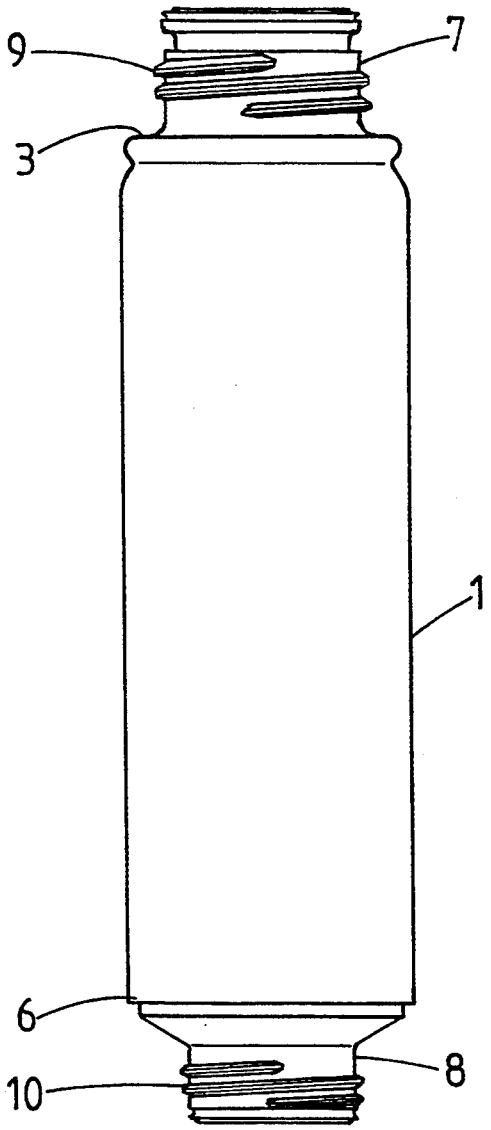
FIG. 2 shows the container by itself.

The container 1, which is to be used as dispenser Sp, is developed for the dispensing of liquid 2 in spray or foam form. For this purpose, it has a function unit referred to as dispensing nozzle D, and a function unit referred to as pump P. The former is located, accessible for actuation, above a head surface 3 of the container 1, over which there is arranged a headpiece 4 of the nozzle D.

On the other end, a downward facing headpiece 5 adjoins a shoulder 6 present there on the container 1.

The container 1, which is developed substantially as a hollow cylinder, is produced by blow molding. A visco-elastic plastic, for instance HDPE, is used.

The upper and lower ends of the container 1 which is designed as a standard standing unit, are each narrowed to form connections 7 and 8 respectively, having external threads 9 and 10 respectively which cooperate with corresponding internal threads on the upper headpiece 4 and lower headpiece 5. A blow container of this type is described in detail in the not previously published German Utility Model Application G 92 08 050.2, the content of which is incorporated in its entirety herein.

Starting from the lower connection 8, a pump cylinder 11 extends into the inside of the container 1, extending almost up to the plane of the head surface 3.

In the direction opposite to this, a dip tube or riser tube 12 extends from the upper headpiece 4 or connection 7, passing to the side of the centrally arranged pump P. This dip or riser tube 12 extends, remaining open on the bottom, down to the level of the shoulder 6.

Pump cylinder 11 and riser tube 12 extend into the liquid 2 over the predominant portion of their length; the pump head 13, however, protrudes out of the liquid 2, i.e. with the maximum level of filling it still protrudes clearly above the maximum liquid level 14. When the unit is standing, the liquid therefore can always flow down immediately from the pump head 13.

The visible part of the function unit pump P is its pump handle 15. The latter consists of a cap which, in the basic position of the pump P, grips over and covers the lower headpiece 5.

Figure 3:
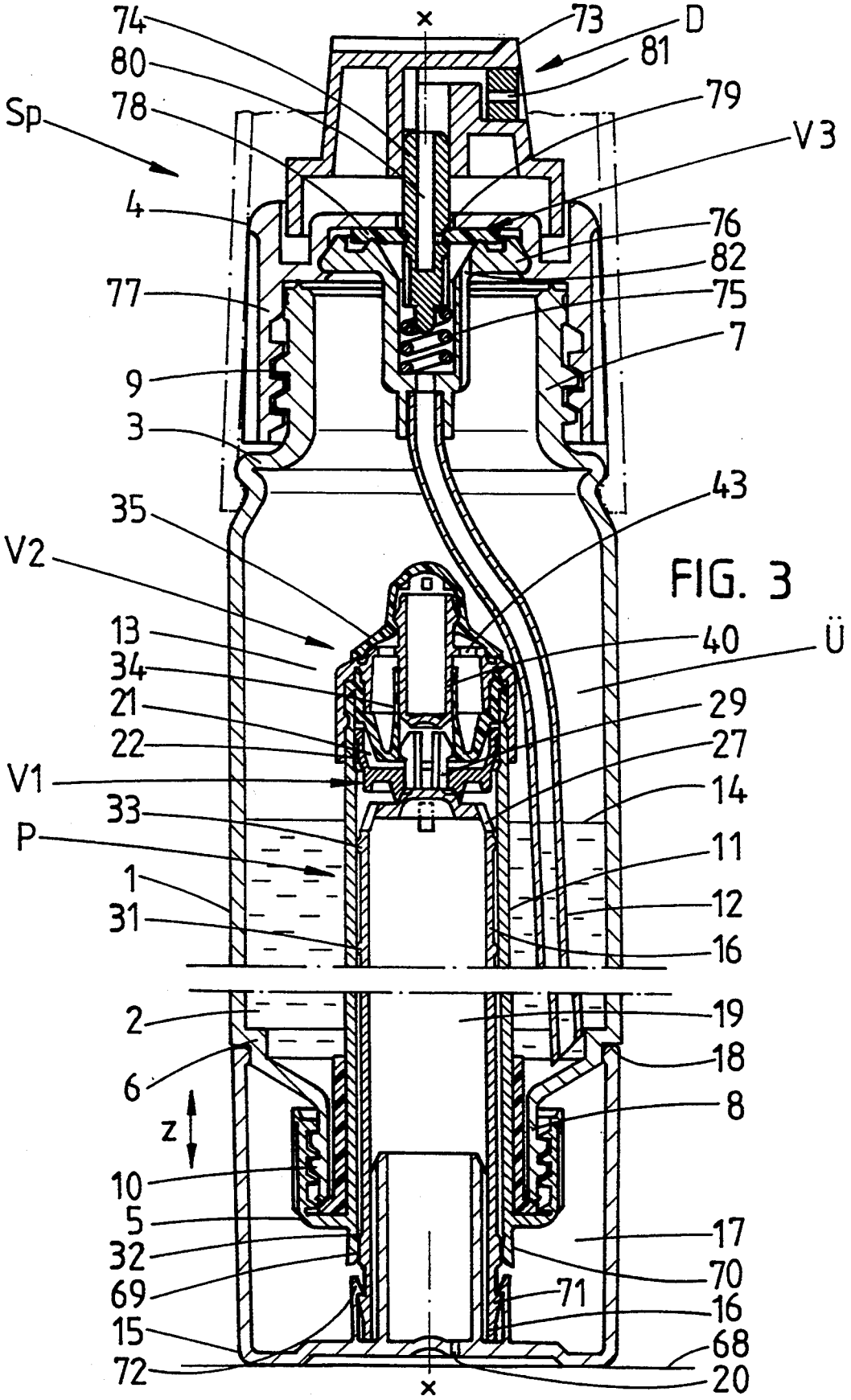
FIG. 3 shows the dispenser in a cross section along the line III—III of FIG. 1, on a larger scale than in FIG. 1.

A tubular piston rod 16 is an integral component of the pump handle 15 or is associated with it by a clip connection or the like (see FIG. 3). It is a tube of round cross section. The cap-shaped pump handle 15 which extends over the lower headpiece 5 forms a sufficiently large cavity 17 and extends, limited by stop, up to the shoulder 9 against the lower side of which the end edge 18 of the pump handle comes, limited by stop.

Pressure is built up by the pump P within the container 1 by the piston rod 16 which is actuated with forward and backward stroke. The air which is forced-in is drawn into the hollow tubular cross section 19. For this purpose, the bottom of the cap-shaped pump handle 15, which bottom at the same time forms the standing surface for the dispenser Sp, has a passage opening 20 for the air. The tubular cross section of the piston rod 16 is retained practically over the entire length of the rod so that the transfer of the air drawn in takes place within the region of the upper end of the pump cylinder 11. For this purpose, a pump piston 12 is seated on the free inner end of the piston rod 16. The pump piston is developed as cuff. Its piston edge which terminates in a sealing lip 23 forms a cup with its opening towards the top. The sealing lip 23 slides over the inner wall surface of the pump cylinder 11.

The pump piston 22 functions at the same time as air inlet valve Va. For this purpose, the pump piston 22, which is formed of flexible or elastic material, is relatively displaceable axially relative to the piston rod 16. The relative displacement is limited and is designated "y" in FIG. 5. Depending on the direction of movement of the piston rod 16, the bottom of the pump piston 22, which is guided with a friction lock, rests via its back or breast against the piston rod. In this way, the passage of air is correspondingly blocked or released.

Upon the forward stroke of the piston rod 16 in the direction of the pump chamber 21, which is thereby reduced in size, the rear of the cup bottom of the piston passes in sealing manner over an annular rib 24 which is arranged concentric to the longitudinal center axis x—x of the piston rod 16. It is molded directly on the rear of the pump piston 22 and terminates in said direction on a flat transverse wall 25 which is present there. The inner flank of the annular rib 24 namely comes in closing fashion against a sealing cone 26. The latter extends as a development from the top of the transverse wall 25. The knifelike end of the annular rib which thus surrounds a valve-seat surface of the sealing cone 26 does not extend up to the top of the transverse wall 25 so that the desired, substantially resetting, sealing application is continuously assured.

Figure 7:
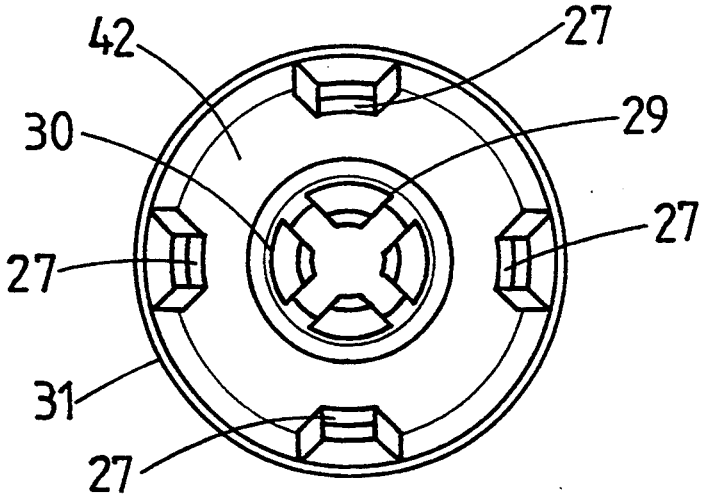
FIG. 7 is a top view of FIG. 6.

The air flow communication between the tubular cross section and the pump chamber 21 is effected via passage openings 27 left in the corner region between transverse wall and cylindrical wall of the piston rod 16. They are window-like openings with shooting-shaft-like widening towards the outside (see FIG. 7). As a whole, there are four such passage openings 27. They lie at equal angular distances apart.

On the other hand, if the piston-cup bottom of the pump piston 22 lifts off from the said sealing cone 26, which takes place due to outward pulling of the piston rod 16, the path becomes free for the drawing-in of the next portion of air, in the manner that the passage openings 27 in the transverse wall 25 receive a fluid communication with a central passage 28 in the cup-bottom of the pump piston 22. The passage 28 is formed by corresponding clearance between the pump piston 27 and a centrally located mandrel 29 which axially guides it. The mandrel adjoins the sealing cone 26 at the top and ends in a mushroom-head-shaped projection 30.

The cup-shaped pump piston 22 is irreversibly clipped onto the said mandrel 29, leaving on the projection side the free passage "y" left in axial direction for the displaceable pump piston 22. The lower flank of the projection 30 and, opposite it, the said sealing cone 26 form the limiting stops.

For the release of the flow path upon the suction process, the mushroom-shaped projection 33 has a crosswise slitting which extends to shortly in front of the upper end of the sealing cone 26. Thus, there remain four individual detent fingers which complement each other to form the entire mandrel 29. Despite the application of the lower flank of the projection 30, the path through the pump chamber 21 is thus kept open. On the other hand, upon application of the annular rib 24 against the sealing cone 26, the above-indicated blocking of the flow path via pump piston 22 takes place, since the diameter of the knife-shaped annular rib 24 is greater than the inside diameter of the central passage 28.

The piston rod 16 is associated in unlosable manner with the pump cylinder 11. For this purpose, in or near the transverse wall 25 on the outer wall of the piston rod, there is a circumferentially extending stop 31 which cooperates with a mating stop 32 on the lower headpiece 5 through which the pump cylinder 11, which is developed simultaneously thereon and forms a collar, continues towards the outside (see FIG. 3). Axially spaced from and practically aligned with the transverse wall 25, there extends an additional ring-shaped rib 33 which, however, serves mainly for guidance but, on the other hand, acts as second detent step. For the attachment and complete removal of the piston rod 16, intentional actuation is therefore required.

The outlet of the pump chamber 21 towards the pressure chamber U of the container 1 is controlled by an air outlet valve V2 which is arranged behind the air inlet valve V1. The air outlet valve V2 is formed of two valves 34 and 35 which operate independently of each other. Their closing action is based on the restoring force of their material and on a loading component of the air pressure produced. The sealed condition can be noted from FIG. 4, and the actuating condition from FIG. 5.

Between the two valves 34, 35, which are connected one behind the other, a volume of air can be enclosed. The pump head 13 which bears the valves 34, 35 leaves for this purpose a chamber, or more precisely an annular chamber 36. The latter forms a sort of lock-gate in which upon the pumping, the volume of air which is under pressure is retained upon passing. The two barrier planes of the valves 34, 35 prevent the emergence of liquid via the pump P.

The first-mentioned valve 34 is a so-called tube valve and is connected as inner valve.

The second valve, designated 35, is a so-called disk valve; it operates as outside valve. It consists of soft PP, while an elastomer is used for the inner valve. The elastomer is one which is able to hold the pressure which has once been built up for a long time in the bottle. By means of the outside valve, the result is obtained that the inner valve in this way comes as little as possible in communication with the product. The outside valve, which produces a flat seal, preferably is under initial tension so that, even in condition without pressure, penetration of the liquid to the inside valve is practically out of the question.

The support of both valves 34, 35 is a valve housing 37 developed in cap shape which is placed on the free end of the pump cylinder 11. This may be an impact attachment or, as shown, a form-locked engagement in the region of the insertion gap 38 of the two parts. The corresponding bead/groove form lock is indicated by the reference number 39 and is self-explanatory on basis of the drawing.

In the center of the cap-shaped valve housing 37 there is a pin 40. The pin extends coaxially to the axis of the pump piston 22 and therefore, at the same time, in the longitudinal center axis x—x of the container 1.

The outer surface of the pin 40 is the inner limitation of the annular chamber 36. An annular wall 41 which extends concentric to the pin 40 forms the external limitation of the annular chamber 36. The ring wall (41) commences in a cover 42 of the cap-shaped valve housing 37.

Around the central pin 41, there are distributed a number of hole-like air outlet openings 43. They lie in the flat portion of the cover 42 which passes peripherally into a hanging-shoulder-like resting-sealing surface 44 as valve-seat surface for the disk valve, therefore the second valve 35. 44 is basically a conical outer surface.

The inner section of the pin 40 which extends freely into the inside of the cap-shaped valve housing 37 bears a valve cuff 45 to form the tube valve. The valve cuff, 45 which is placed-on with slight initial tension, holds itself fast on a suitably premounted assembly of the valve housing 37. For easy attachment of the tubelike valve cuff 45, the lower free end of the pin 40 is beveled in the region of its edge. In this way, there is produced a sort of insertion cone 46. The pin 40 increases slightly in cross section in upward direction.

The outer section of the pin 40 which continues upward above the cover 42 is used for the attachment of the disk valve, namely the second valve 35. The disk valve is held by clip on the pin 40. A pin-side clip bead bears the reference numeral 47. It is gripped below in the insertion attachment of the valve disk by a mating clip bead 48 thereof. Said bead is located above the disk projection 49 of the disk valve which is of bell shape as seen in cross section. The disk extension 49 or bell edge passes clearly into a central dome-shaped continuation 50 which engages in hood shape over the pin 40 at the end facing away from the pump piston 22.

The pin 40 is designed as hollow pin. It is open towards the top. The edge of the opening finds support with respect to the dome-shaped extension 50 by inner insertion-limiting blocks 51.

The clip attachment cannot be pushed off by the air flowing in over the annular chamber 36 for the formation of the air cushion in the pressure chamber U . The flatly conical bell edge or disk extension 49 imparts the valve body a certain stabilization also as a result of the shaping.

In the resting-sealing surface 44 for the disk valve there is a groove 52. it is an annular groove which is open towards the top and has a transversely convexly rounded bottom. Above the groove 52 there is a sealing bead 53 in the region of the valve disk close to the edge.

The sealing bead 53 forms, as seen in cross section, an approximately semicircular accumulation of material of rotational symmetry. The diameter of this circular, bottom-side surface of the sealing bead 53 is greater than the radial distance, measured in the plane of the descending sealing surface 44, between edges 54 and 55 of the groove 52 which extend parallel to each other. This leads (see FIG. 4) to an inner, first sealing zone a and to a second, outer sealing zone b between sealing bead 53 and resting-sealing surface 44, i.e. edges 54, 55. In suitable sealing condition, possibly with the use of initial stress, the sealing bead 53 can extend, with merely edge contacting of the groove 52, only parallel into said groove 52. A free space 51 is thus obtained in the groove 52.

Thus, connected to the annular chamber 36 which contains a volume of air under pressure there is a second separate air volume which is also under pressure. Any reduction in pressure which may occur drives through it any portions of liquid continuously out of the pump head 13, the pressure still present above the surface 14 of the liquid on the other hand always acting to close the valves 34, 35.

Figure 4:
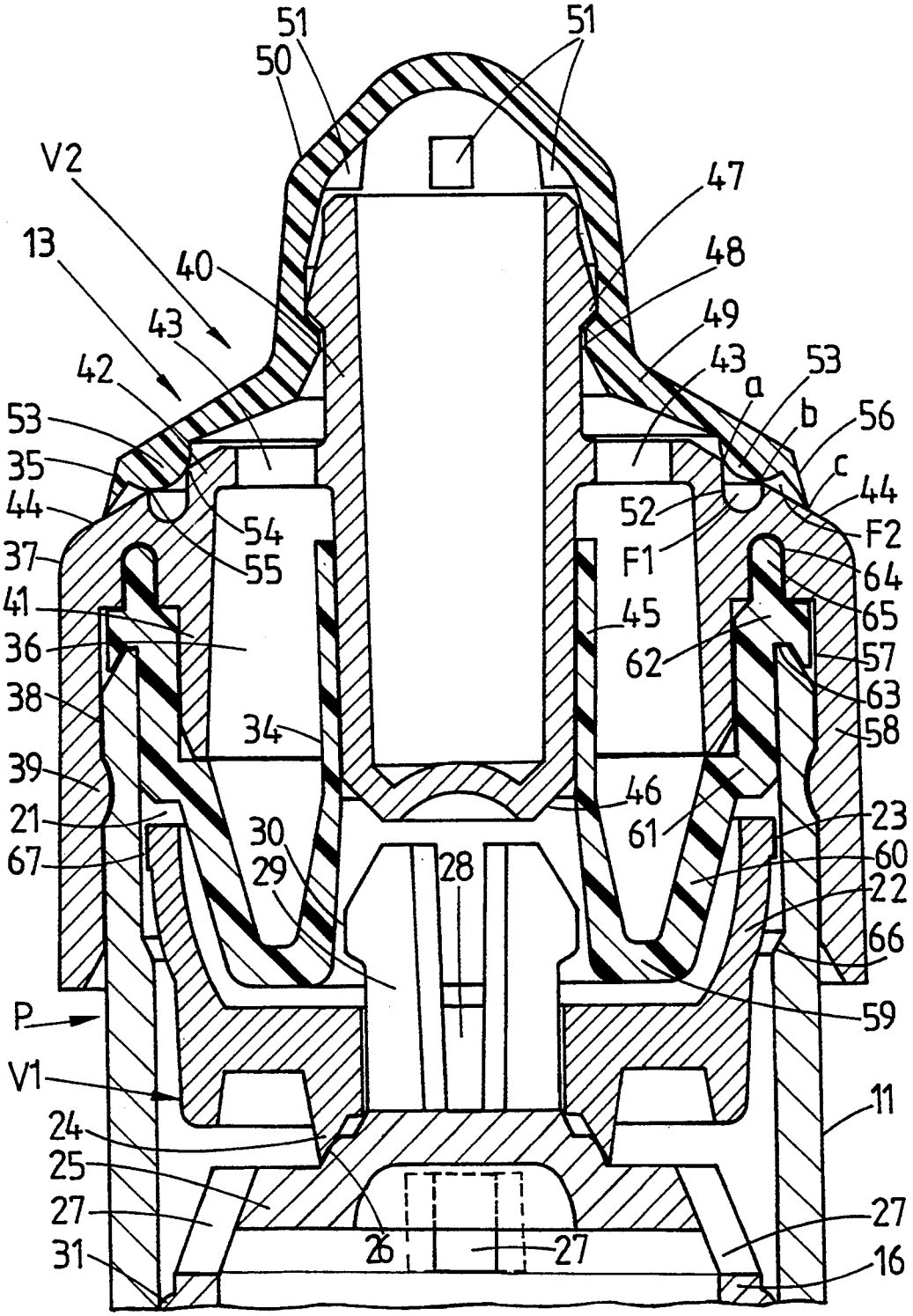
FIG. 4 shows the top piece of the pump in a sectional showing which is further enlarged as compared with FIG. 1, seen in sealed state.
Figure 5:
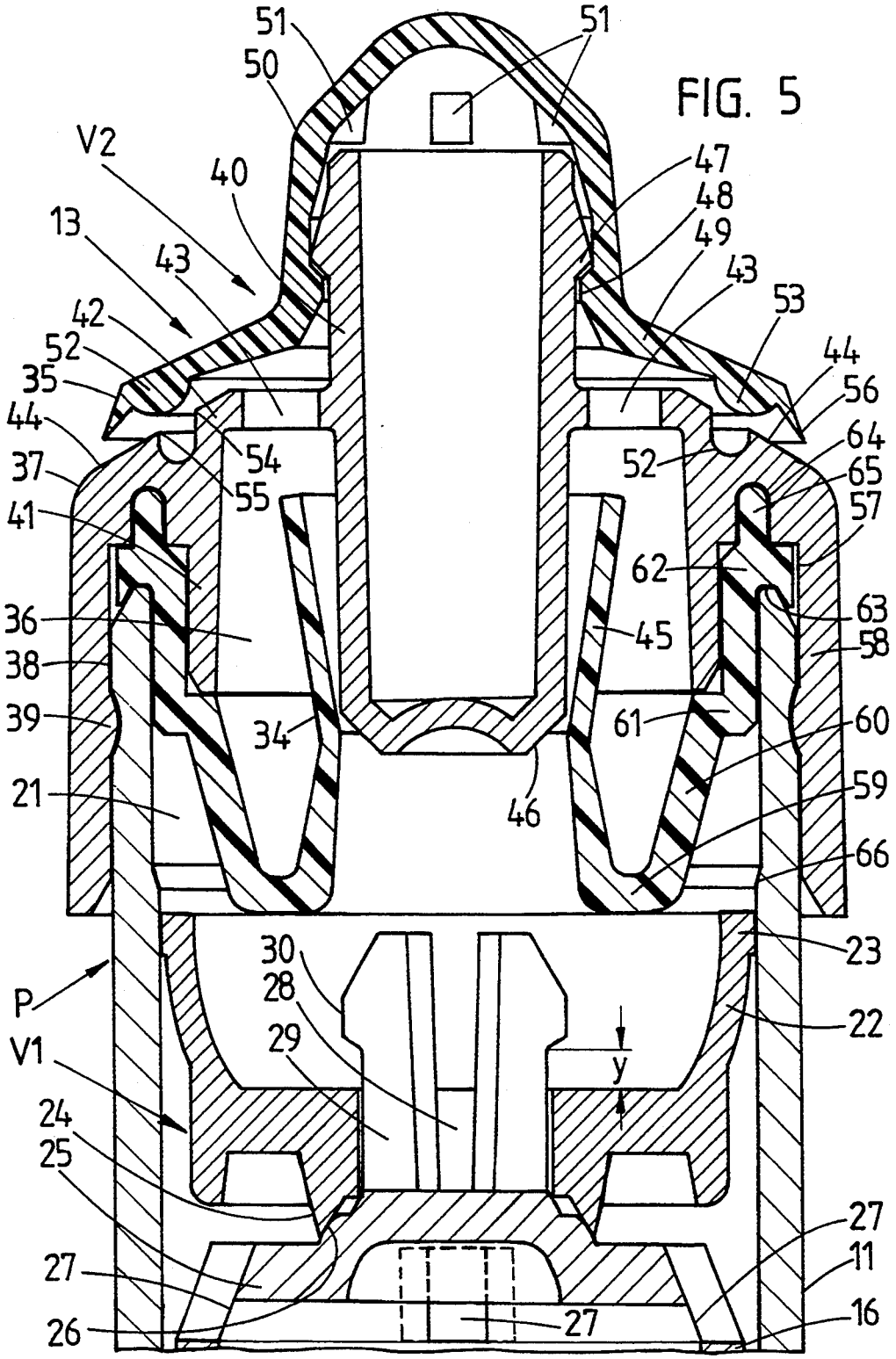
FIG. 5 is a similar section during the pressure-storing pumping.
Figure 6:
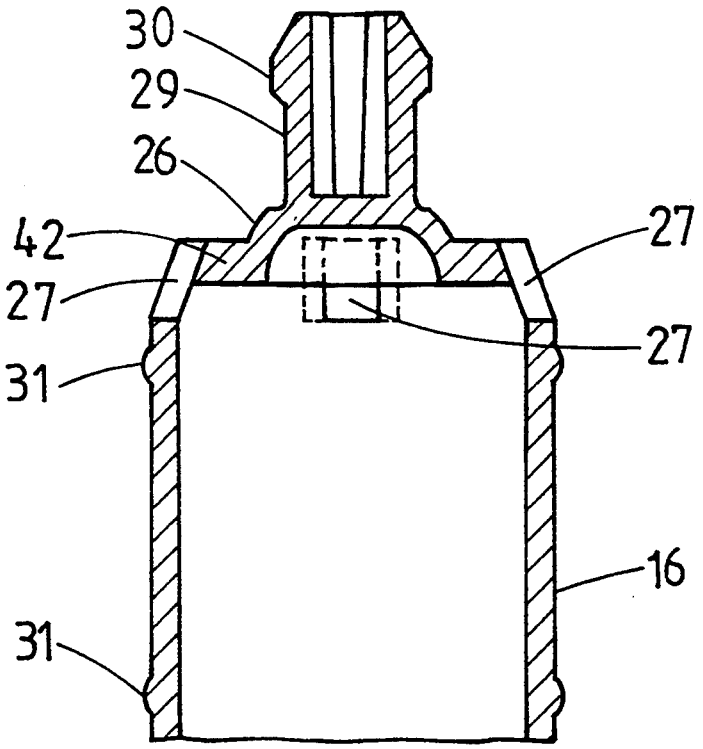

As can further be noted from FIGS. 4 and 5, an outer lip 56 which rests, as seen in the direction of flow, behind the sealing bead 53 is provided. In sealing condition (FIG. 4) it also comes against the resting-sealing surface 44. The lip of this lipping 56 terminates in the manner of a knife and exerts a high sealing and closing action. It places only the inner of this lipping 56 on the said surface 44. For this, the circumferential lip is placed oblique.

The descending acute-angled lipping 56 lifts off on the inner flank from the sealing surface 44 so that a second free space F2 is present there, it containing a separate volume of air. The width of said air space F2 in radial direction corresponds to the inside width between the sealing zone a and the sealing zone b. The knife-like edge of the lipping 56 creates in the said distance from b therefore another sealing zone c. F1 and F2 contain pressure which, however, is dominated by the pressure cushion acting on the surface 14 of the liquid.

The inner valve, and therefore the first valve 34, can be inserted premounted in a surrounding shaft 57 which is formed between an outer wall 58 of the valve housing 37 and the annular wall 41 thereof.

As can be noted, the annular wall 41 extends back in axial direction with respect to the end surface of the outer wall 58. In this way, the inside of the valve housing 37 which lies thereunder can be used for the arrangement of the base region of the valve cuff 45. This base region is folded in V shape, in the manner that, adjoining a base-side bend 59, an upward-extending, stepped arm 60 enters as anchoring section 60 into the shaft 57. The step bears the reference numeral 61. Via it, there is obtained support of the arm 60 on the downward facing edge of the annular wall 41.

The free end of the stepped arm 60 is folded to the outside in opposite direction and therefore downward. It forms a sort of hook portion which grips in anchoring manner over the upward directed edge 63 of the pump cylinder 11. Furthermore, the base of the shaft 57 continues further into a depression 64. A circumferential web 65 extends into the latter. In this way, there is obtained a gap labyrinth of high sealing action.

The hook portion consists of a clear accumulation of material, the actual hook section also extending over a beveled, outward zone of the annular wall 63. The parts 34 and 37 can thus be preassembled.

The step 61 creates, between the inner wall of the pump cylinder 11 and the backward extending outer wall of the arm 60, sufficient free space for the axial entrance of the cup-shaped pump piston 22 into the pump chamber 21.

The latter also contains a special feature insofar as the cylindrical inner wall of the pump cylinder 11 forms, within the pump head 13, a pressure-equalization device which consists simply therein that the pump cylinder 11 has a step 66 there. This step leads to an enlarged inside cross section of the pump chamber 21. Having entered this end region of the pump piston 22, the sealing lip 23 thereof extends practically in a free-standing position, i.e. the pressure cushion built up in front of the pump piston fence 22 in the pump chamber 21 suddenly drops down. The pressure escapes, flowing around the outside of the cup-shaped pump piston 22 over an annular slot 67 between sealing lip 23 and the corresponding wall section of larger cross section of the pump chamber 21. Via the rear of the pump piston, it then passes through passage openings 27 over the pipe cross section 19 and the passage opening 20 to the outside.

Figure 9:
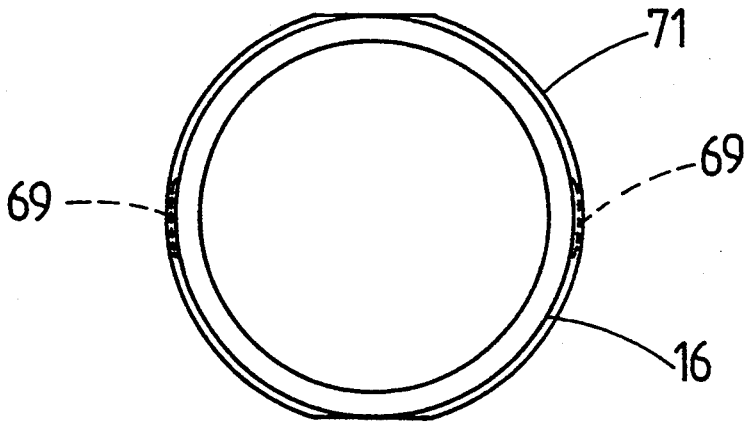
FIG. 9 is a bottom view of the piston rod.
Figure 8:
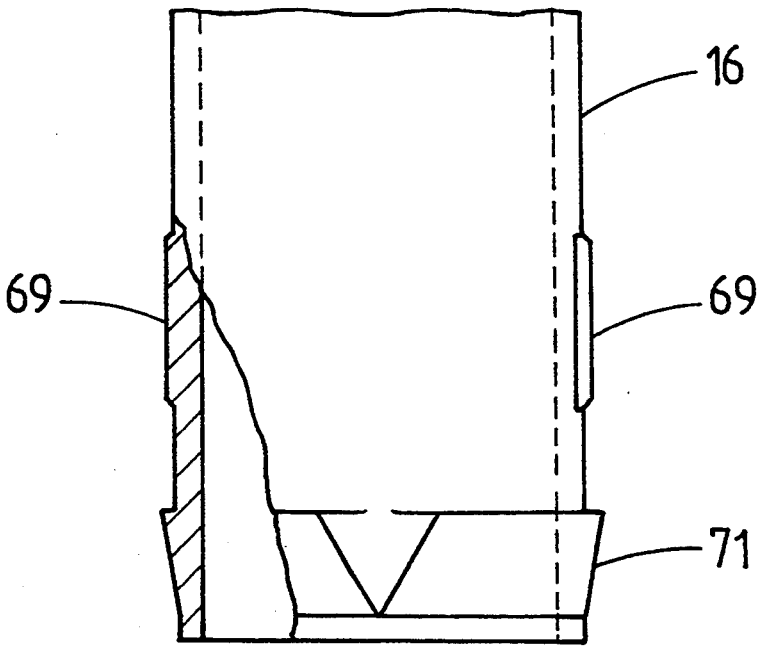
FIG. 8 shows the lower end of the piston rod, representing the measure in accordance with claim 11.

In order, upon the lifting of the dispenser Sp developed as a stand-up instrument from its standing surface 68, to avoid a lowering of the piston rod 16 into a bottom position of protrusion, which would, in principle, be possible due to the section of larger cross section in the pump chamber 21 and the free passage y described, a sort of slip brake is established. It consists therein that, on the other surface of the piston rod 16, a frictional-lock protrusion 69 is developed. The protrusion is so placed that the corresponding application by frictional lock on the pump cylinder 11 guiding the piston rod 16 enters into action only when the pressure equalization position is reached (FIG. 4). The mating friction surface is the inner wall of the pump cylinder 11, namely in a connector-like extension 70 which clearly extends beyond the lower side of the lower headpiece. The mating surface can, instead of this or in addition to this, have a friction-lock protrusion. As can be noted from FIGS. 8 and 9, two friction-lock protrusions 69 are present diametrically opposite each other on the end there of the piston rod 16.

Furthermore, from the said figures there can be noted a detent projection 71 which cooperates with detent hooks 72 extending from the bottom of the cap-shaped pump handle 15. With a circumferential detent projection 71, it is advantageous to develop three detent hooks 72 arranged at equal angles apart on the bottom.

The delivery nozzle D is of customary construction and will only be briefly described, solely for an understanding of its function. It consists of a push-button 73 which actuates another outlet valve V3. The push-button continues in a central ram 74 which is spring-loaded in the direction of the basic position. The compression spring acting on said ram bears the reference numeral 75 and is seated in an insert part 76 which forms, with an upper section, a spring chamber for the compression spring 75 and, in a lower section, a support to receive the riser tube 12.

The insert part 76 is clipped in the cover of a screw cap 77 with central opening which forms the upper headpiece 4. There is concerned here a disk-shaped section which bears on its top a sealing ring 78 and clamps the latter against the bottom of the cover of the screw cap 77. The hole edge of the sealing ring 78 lies in tightly sealing manner in front of a transverse channel 79 of the ram 74, which transverse channel 79 is connected with a central outlet channel 80 in the center of the ram 74. The latter conducts the fluid to be discharged to a nozzle 81 in order to produce a spray jet or a foam jet.

The central region below the sealing ring 78 is removed and is in fluid communication, via one or more air channels 82, with the compressed-air volume of the container 1.

As soon as the push-button 73 is pushed downward, the hole edge of the sealing ring 78 leaves the peripheral mouth of the transverse channel 79. In this way, the liquid entering within the riser pipe 12 can pass, due to the pressure above the surface 14 of the liquid, into the delivery path, with the admission of optimally spraying or foaming air via the said air channels 82.

Figure 10:
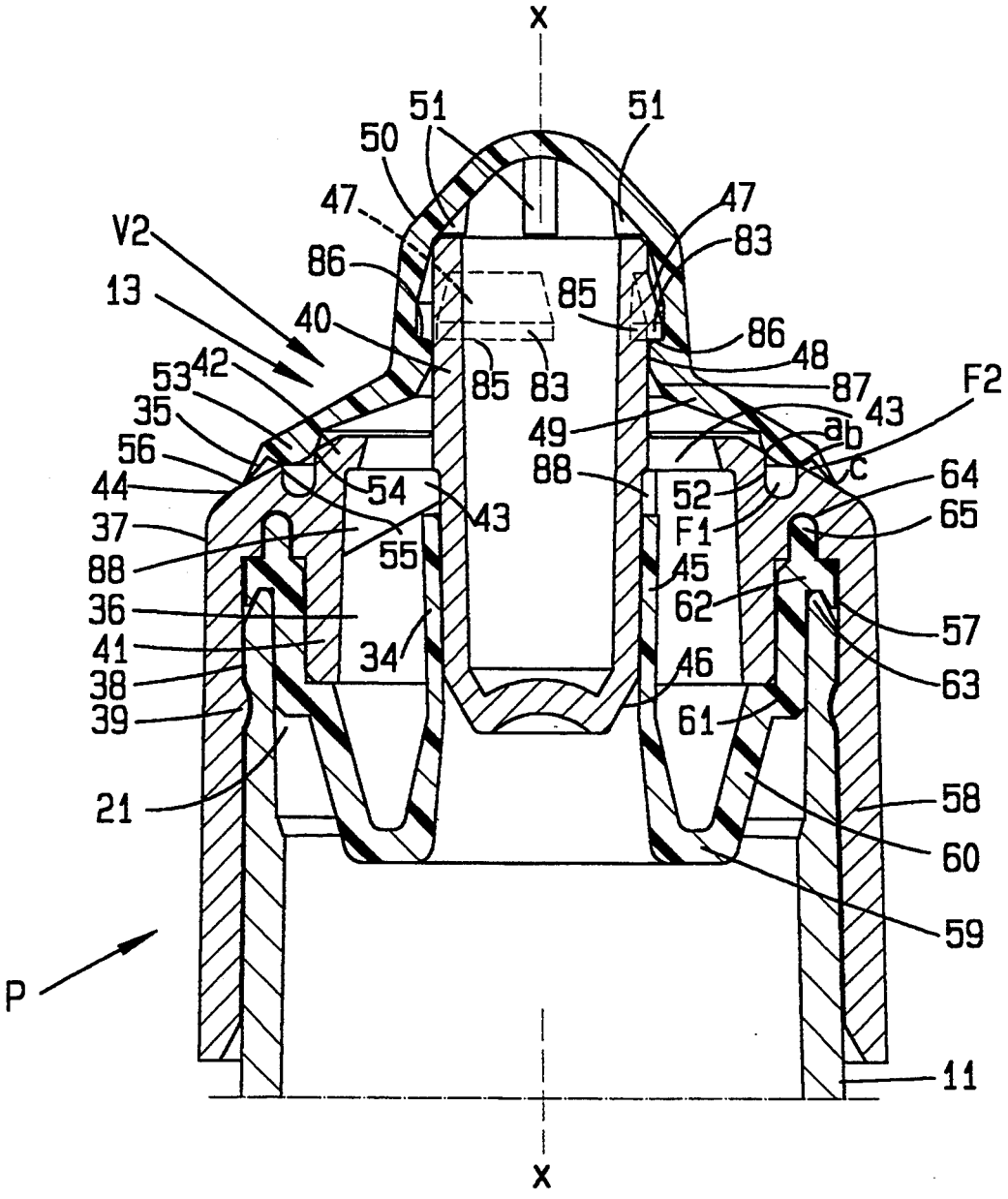
FIG. 10 is a showing corresponding to FIG. 4, but with the pump piston retracted and a modified shape of the clip bead.
Figure 11:
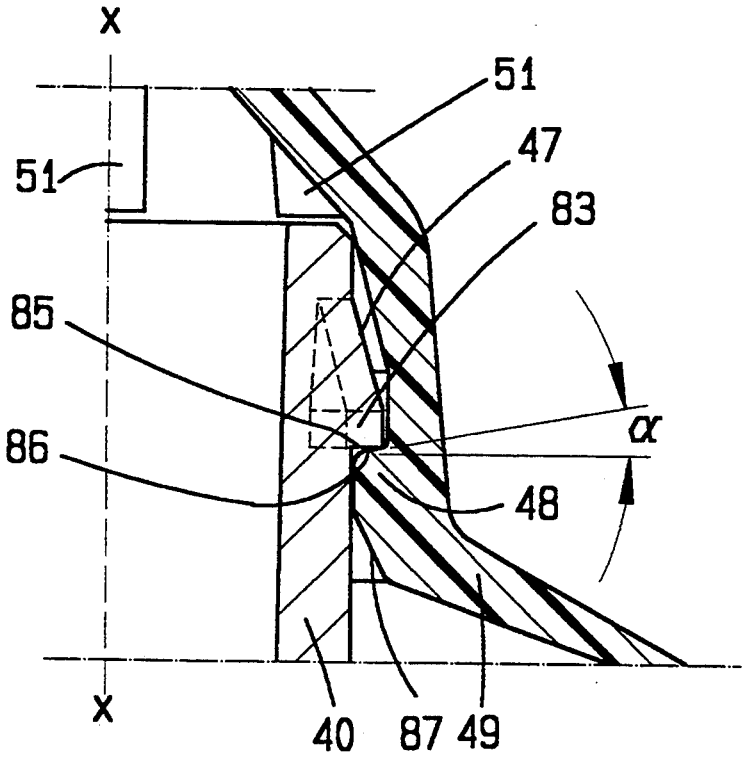
FIG. 11 is an enlarged view of a portion of the clip bead shown in FIG. 10.
Figure 12:
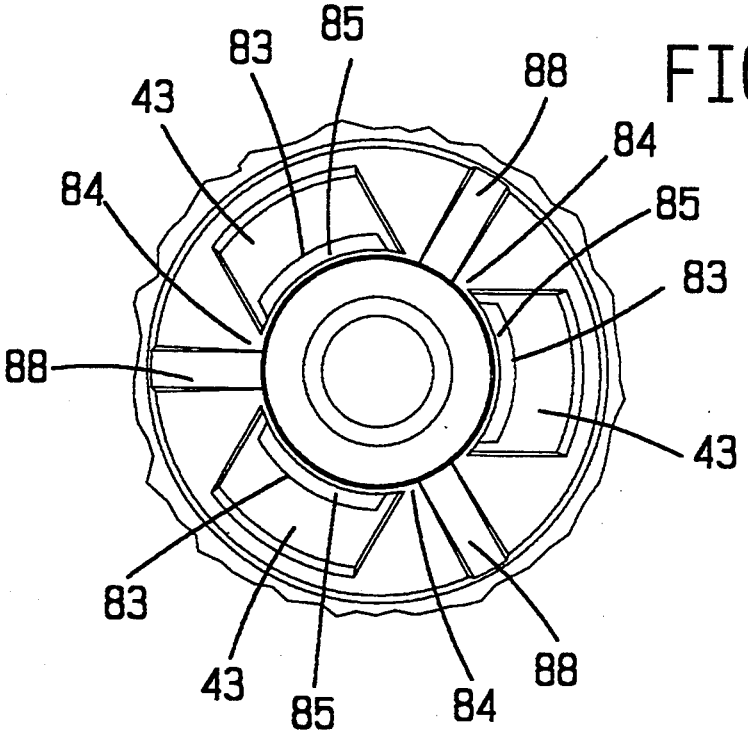
FIG. 12 is an inside view into the valve housing with the valve omitted.

The variant shown in FIGS. 10 to 12 concerns a further development of the clip mounting between valve disk and valve housing 37 and pin 40 respectively. The reference numerals are, in part, applied by analogy without repeating the corresponding text. While the variant described above is directed at a continuous circumferential clip bead 47, the further development shows a clip bead 47 which is in the form of individual clip noses 83. They are arranged aligned axially at equal distances apart on the circumference or outer surface of the pin 40. They are developments formed thereon.

As can be noted from FIG. 12, three such clip noses 83 are present. Their length, measured in circumferential direction, corresponds essentially to the length, also measured in circumferential direction, of the spaces 84 remaining between the clip noses 83.

The holding device in this connection for the valve disk does not require any circumferential undercut forcefully removed from the mold. The lower flank 85 of the clip noses 83 is rather developed with a sharp edge. They (85), taking into account the standing position shown, extend in a common horizontal plane, and therefore perpendicular to the longitudinal center axis x—x of the piston rod, and not with an approximately 45° bevel as shown, for instance, in FIG. 4.

In order to be able easily to effect the corresponding removal from the mold of the lower flank 85, the hole-like air outlet openings 43 discussed in connection with the variant described above can be used. Dispensing with a more hole-like opening, there are present the window-shaped openings visible in FIG. 12, also referred to as air outlet openings 43. The corresponding ram of the mold (not shown) moves from the bottom, passing by the cover 42 of the valve housing 37, up into the mold region of the clip noses 83 lying above the cover 42. As can be noted from FIG. 12, the inner edge of the air outlet opening 43 which faces the center follows identically the course of the cylindrical outer surface of the tubular pin 40. The molding regions lying above the cover 42 are therefore precisely obtained.

The valve disk has, in this case also, the mating clip bead 48 described above, which, on its top side, and therefore facing the clip nose 83, has a detent flank 86. The latter extends as annular shoulder without interruption.

The lower flanks 85 of the clip noses 38 form an angle of less than 20° with a corresponding detent flank 86 of the valve disk. In the embodiment shown an angle of about 10° has been taken as basis. 86 rises directed outward at this angle.

It has been found that an undercut, force-removed from the mold in holding direction in the said value is sufficient on the valve disk. No larger or essentially larger mold-removal angle is required. This has considerable advantages with respect to the attachment of the valve disk. By the corresponding angle dimensioning it is possible, upon possible swelling of the valve disk, which swelling can actually be caused in part by the different products placed in the dispenser, that the vertical play can no longer be so large and the initial tension of the sealing lip 53/56 against the valve housing 37 is thus better retained. This leads to an increased functional reliability and tightness. The dependable functioning of the valve disk is very important since it is made of a soft polypropylene and is thus more resistant to many products than the inner valve 34 which is preferably made of the elastomer Santoprene.

The detent flank 86 passes via a convex transverse rounding into the inwardly directed annular surface of the mating bead 48, which annular surface opens in funnel-shaped fashion towards the cover 42 and therefore forms a run-on surface 87 of rotational symmetry. Together with the nose backs of the clip noses 83 which are beveled in the same direction, this facilitates the assembly.

The insertion limitation is established also in this variant by blocks 51 which, merely for better recognition, leave a light gap between the end surface being applied and the corresponding ring end surface of the tubular pin 40.

Radial struts 88 which connect cover 42 and annular wall 41 with each other stiffen the valve housing 37. Said struts are located in the angle bisectors between the air outlet openings 43.

The function, summarized briefly, is as follows: By actuation of the pump handle 15 in the direction of the double-ended arrow z shown in FIG. 3, air is drawn into the pump chamber 21 upon the extraction of the piston rod 16 through the inlet-valve passage openings 27. This is possible since the pump piston lifts off in form-locked manner from the sealing cone 26. The air passes through the central passage 28. Upon reaching the end position, the piston rod 16 is pressed upward. The rear of the pump piston 22 then applies its annular rib 24 in sealing manner against the sealing cone 26. The air enclosed in the pump chamber 21 enters into the annular chamber 16 passing by the first valve 34. For this purpose, the valve cuff 48 lifts off from the pin 40. This is done in opposition to the restoring force of the said valve cuff 45. The air which is under pressure flows from the annular chamber 36 to the second valve 35. This disk valve lifts off from its resting-sealing surface 44 so that the air passes through the air outlet openings 43 into the pressure chamber 0 of the container 1. After each pump stroke, the valves 35 and 35 of the air outlet valve V return to their basic position. After sufficient storing, the dispenser is operable, i.e. for the dispensing it is merely necessary to actuate the push-button 73 in the manner described. The pressure cushion can be freshened from time to time.

Upon the reaching of the bottom position, the piston rod 16 or its pump piston 22 comes into the above-described pressure-relief position in which it is held by friction lock, as described.

I claim:

1. A container (1) for the dispensing of liquid (2), particularly for dispensing in spray or foam form, with dispensing nozzle (D) arranged on the head side of the container (1) and a pump handle (15) for a pump (P) associated with the container, with pump cylinder (11), piston rod (16) and pump piston (22) for producing a pressure cushion above the surface of the liquid (14), the pump chamber (21) having an air inlet valve (V1) and an air outlet valve (V2), characterized by the fact that the air outlet valve (V2) consists of two valves (34, 35) which are connected one behind the other and between which a volume of air can be enclosed.

2. A container according to claim 1, the first valve (34) being a tube valve, characterized by the fact that the second valve (35) is a disk valve.

3. A container according to claim 1, characterized by the fact that an annular chamber (36) with respect to a pin (40) arranged coaxially to the axis of the pump piston (22) is formed for the enclosed air volume.

4. A container according to claim 3, characterized by the fact that the pin (40) cooperates with a valve cuff (45) in order to form the tube valve.

5. A container according to claim 3, characterized by the fact that the pin (40) furthermore serves for the fastening of the disk valve.

6. A container according to claim 3, characterized by the fact that the disk valve is developed in bell shape in cross section, gripping over an end of the pin (40) facing away from the pump piston (22).

7. A container according to claim 3, characterized by the fact that the disk valve is held by a clip bead (47) on the pin (40).

8. A container according to claim 1, characterized by the fact that a groove (52) is developed in a resting-sealing surface (44) the disk valve, and a sealing bead (53) of the disk valve lies at least partially in a sealing state in said groove.

9. A container according to claim 8, characterized by the fact that the sealing bead (53) rests on upper edges (54, 55) of the groove (52), leaving a free space (F1) in the groove (52).

10. A container according to claim 8, characterized by the fact that an outer lipping (56) lying behind the sealing bead (53) in the direction of flow is provided on the disk valve, said lipping resting in sealing condition on the resting-sealing surface (44).

11. A container according to claim 1, characterized by the fact that a friction-lock protrusion (69) is formed on an outer surface of the piston rod (16) and enters into action upon the end of a pumping process.

12. A container according to claim 1, characterized by the fact that a clip bead (47) is developed on the pin in the form of individual clip noses (83).

13. A container according to claim 12, characterized by the fact that the clip noses (83) are located in the region of air outlet openings (43).

14. A container according to claim 12, characterized by the fact that the disk valve forms a detent flank (86) for engagement on the clip noses (83).

15. A container according to claim 12, characterized by the fact that a lower flank (85) of the clip noses (83) forms an angle of less than 20° with the detent flank (86) of the valve disk.

16. A container according to claim 15, characterized by the fact that the angle amounts to about 10°.

17. A container according to claim 15, characterized by the fact that the lower flank (85) of the clip noses (83) extends in a horizontal plane and/or perpendicular to a longitudinal center axis (x—x) of the piston rod (16).

* * * * *